United States Patent [19]

Deutschmann et al.

[11] Patent Number: 4,534,324

[45] Date of Patent: Aug. 13, 1985

[54] VALVE CONTROL FOR A RECIPROCATING PISTON INTERNAL COMBUSTION ENGINE

[75] Inventors: Herbert Deutschmann; Hans Dinger, both of Friedrichshafen, Fed. Rep. of Germany

[73] Assignee: MTU-Motoren-und Turbinen-Union Friedrichshafen GmbH, Fed. Rep. of Germany

[21] Appl. No.: 533,452

[22] Filed: Sep. 19, 1983

[30] Foreign Application Priority Data

Apr. 13, 1983 [DE] Fed. Rep. of Germany ..... 3313225

[51] Int. Cl.[3] ..... F01L 1/26

[52] U.S. Cl. ..... 123/90.22; 123/90.46

[58] Field of Search ..... 123/90.22, 90.4, 90.46

[56] References Cited

U.S. PATENT DOCUMENTS 1,287,037 12/1918 Johnston ..... 123/90.22
2,070,926 2/1937 Sander et al. ..... 123/90.22
3,140,698 7/1964 Voorhies ..... 123/90.46
3,633,556 1/1972 Inoue ..... 123/90.22

FOREIGN PATENT DOCUMENTS 354116 8/1931 United Kingdom ..... 123/90.22

*Primary Examiner*—William R. Cline
*Assistant Examiner*—Peggy A. Neils
*Attorney, Agent, or Firm*—Craig and Burns

[57] ABSTRACT

A valve control for a reciprocating piston internal combustion engine in which at least two valves per cylinder are actuated in unison by a traverse moved by a rocker arm; the pivotally constructed traverse adapts itself to different valve stem heights of the valve pair by assuming different inclined positions; a self-adjusting torque support mechanism cooperates with the traverse and limits the inclination of the traverse to the extent resulting from the differences of the valve stem heights; an accurate synchronous operation of the valves actuated in unison is assured thereby.

6 Claims, 2 Drawing Figures

VALVE CONTROL FOR A RECIPROCATING PISTON INTERNAL COMBUSTION ENGINE

Figure 1:
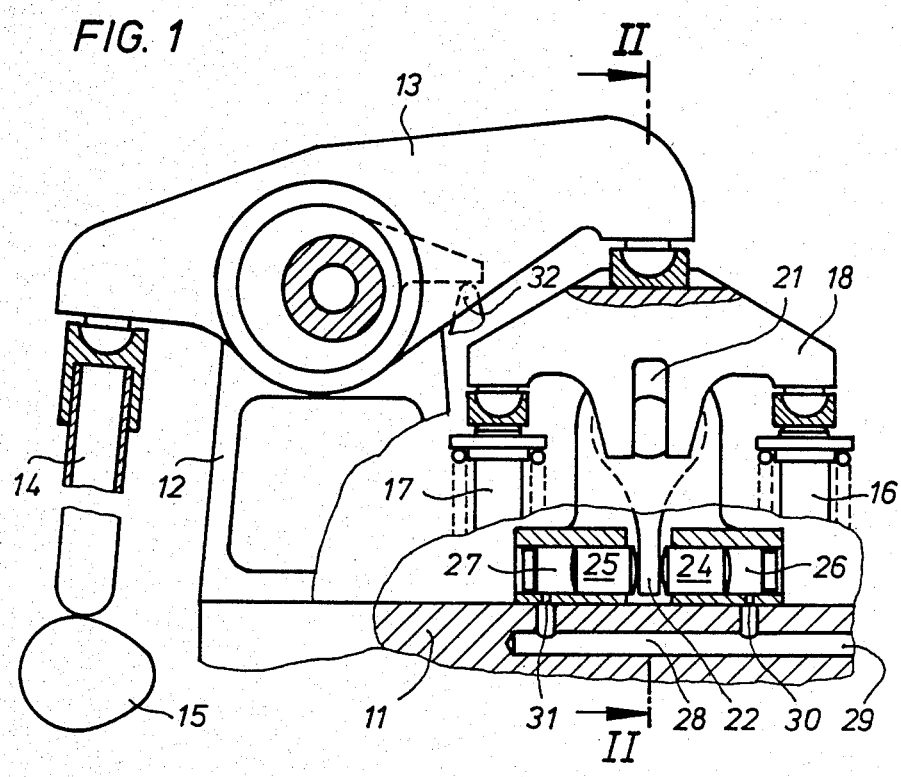

The present invention relates to a valve control for a reciprocating piston internal combustion engine in which at least two valves per cylinder head are actuated in unison by a traverse displaced by a rocker arm and in which the traverse is constructed so as to be pivotal. The valve control is thereby so constructed the the traverse can adapt itself to differences in the valve stem heights of the pairwise-actuated valves.

In a valve control disclosed in the German Gebrauchsmuster No. 1885715, a valve pair is actuated in unison by means of a traverse. The traverse is rotatably supported at the rocker arm on a pin so that it can adapt itself to different valve stem heights by assuming different inclined positions. The pivot range of the traverse which is dimensioned generous is limited by abutments.

It is disadvantageous in this prior art arrangement that the traverse tilts like a scale-beam during the opening phase of the valve pair as soon as the opening forces required for the two valves are not in equilibrium. Such an imbalance results from different valve spring forces which are conditioned on manufacturing tolerances, and by different friction conditions at the valve stem guidances of the valve pair. The valve of the pair, at which the lower opening forces occur, thereby leads during opening with respect to the other valve of the pair. The magnitude of this lead depends, at which inclined or tilted position of the traverse the opening forces of the two associated valves are in equilibrium. In the most unfavorable case, the traverse pivots so far that only the abutments prevent the further tilting. In particular for rapidly rotating reciprocating piston internal combustion engines, such an imperfect equilibrium or deficient synchronous operation of the valves of a commonly actuated pair is not permissive. On the one hand, the necessary precision of the gas exchange processes is considerably disturbed. On the other hand, the trailing valve is torn open with higher velocity than the leading valve. Large acceleration forces result therefrom which lead to overloads and excessive stresses in the valve control endangering the operation.

It is therefore the task of the present invention to indicate measures which automatically limit the tilting of the traverse to the extent which results from the differences of the valve stem heights.

The underlying problems are solved according to the present invention in that a bolt rectilinearly guiding the traverse is rotatably arranged at the cylinder head transversely to the connecting line of the valves, in that the bolt is rotatable by the traverse by way of the rectilinear guidances and in that the bolt cooperates with an automatically adjusting torque support mechanism.

The advantages achieved with the present invention consist in particular in that the pivot position assumed by the traverse as a result of the different valve stem heights remains unchanged during the opening phase of the valves, in that the traverse is able to adapt itself to the valve stem heights which change slowly during the operation as a result of wear, in that in each inclined position of the traverse, an exact synchronous operation of a commonly actuated valve pair is assured, in that also the inaccuracy in the synchronous operation of the commonly actuated valve pair is eliminated which would otherwise result by play in the valve control between cam shaft and traverse, and in that the moved masses of the valve control are not increased by the proposed arrangement in accordance with the present invention.

Figure 2:
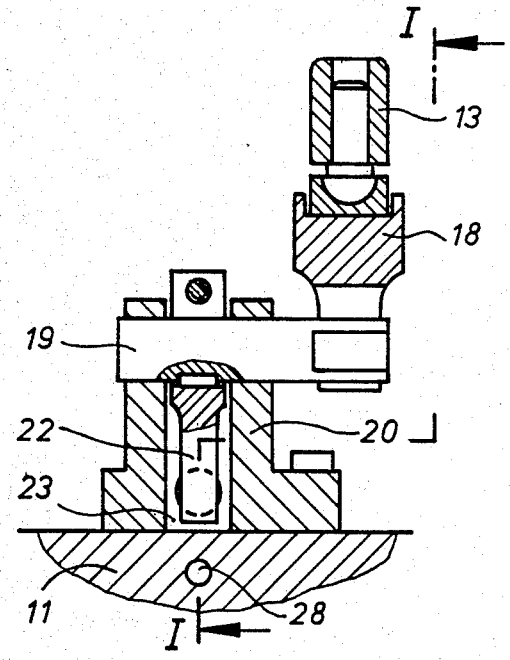

These and further objects, features and advantages of the present invention wil become more apparent from the following description when taken in connection with the accompanying drawing which shows, for purposes of illustration only, one embodiment in accordance with the present invention, and wherein:

FIG. 1 is a somewhat schematic view of a valve control for a valve pair in accordance with the present invention, partly in cross section; and taken along line I-I of FIG. 2; and FIG. 2 is a cross-sectional view of the valve control of FIG. 1, taken along line II-II of FIG. 1.

Referring now to the drawing wherein like reference numerals are used throughout the two views to designate like parts, a rocker arm 13 is arranged on a bearing block 12 on a cylinder head 11, indicated only schematically, of a reciprocating piston internal combustion engine.

The rocker arm 13 is operatively connected, on the one hand, by way of a push rod 14 with a cam shaft 15 and, on the other, with a traverse 18. The traverse 18 rests on the valve stem ends of two adjacent valves 16 and 17 which are actuated in unison by the traverse 18.

A mechanism for the elimination of play of any conventional construction is arranged in the transmission path for the valve actuation between the cam shaft 15 and the traverse 18. In the illustrated embodiment, this mechanism consists of a conventional hydraulic adjusting member 32 which cooperates in a suitable manner with an eccentric bush of the rocker arm bearing support and effects automatically a clearance compensation.

Transversely to the connecting line of the valve pair, a bolt 19 is rotatably supported at the cylinder head 11 in a bearing block 20 centrally between the valves 16 and 17. The bolt 19 includes at its projecting end two mutually parallel surfaces, which cooperate with a fork-like slot 21 of the traverse 18 and effect a rectilinear guidance for the traverse 18. The bolt 19 is rotatable by the traverse 18 by way of the rectilinear guidance if the traverse assumes an inclined position as a result of different valve stem heights. A lever 22 is non-rotatably connected with the bolt 19 which projects into an opening 23 of the bearing block 20. Two pistons 24 and 25 actuated by oil pressure and engaging at the lever 22 mutually oppositely are arranged in the bearing block 20 at right angle to the lever 22, which together with the lever 22 form a self-adjusting torque support mechanism for the bolt 19, with respect to the traverse 18.

The cylinder spaces 26 and 27 of the pistons 24 and 25 are communicatingly connected with each other by a channel 28. The channel 28 and the cylinder spaces 26 and 27 are filled with pressure oil from the lubricating oil circulation of the reciprocating piston internal combustion engine by way of a line 29. Throttling places 30 and 31 are arranged in the connections between the channel 28 and the cylinder spaces 26 and 27 of the pistons 24 and 25.

Differing friction conditions at the valve stem guidances and differences of the valve spring forces caused by manufacturing tolerances create that the forces to be overcome during the opening of the valves which are of different magnitudes at the two valves of a commonly actuated pair. The force difference resulting therefrom is thereby responsible for the fact that the traverse 18, during each valve actuation, seeks to change its starting position up to the equalization of the force difference. In the interest of an exact synchronous operation of the two valves 16 and 17 of a commonly actuated pair, the positional change of the traverse 18 which occurs during short periods of time is to be prevented. The torque resulting from the force difference defined above and engaging at the traverse 18 is transmitted by way of the rectilinear guidance onto the bolt 19 and the lever 22 and depending on the direction of rotation of the torque is supported at one of the oil pressureactuated pistons 24 and 25. Though the piston acted upon by the torque seeks to deflect, the throttle places 30 and 31 coordinated to the pistons delay a rapid overflow of pressure oil from the one cylinder space by way of the channel 28 into the other cylinder space. The openings of the throttle places 30 and 31 are so dimensioned that during the opening phase of the valves 16 and 17, practically no adjustment of the traverse 18 occurs.

If during operation a larger valve stem height difference should result due to wear at the valve seat of one of the valves 16 and 17 of a commonly actuated pair, then the torque resulting therefrom which adjusts the traverse 18 is effective only during the closure phase of the valve pair. The closure phase of the valves 16 and 17, however, is more than twice as long as the opening phase. The piston acted upon by the lever 22 as a result of the adjusting force has therefore considerably more time during the closing phase to displace pressure oil out of its cylinder space than during the opening phase. Additionally the adjusting torque is also larger than the torque resulting from the force difference during the opening phase because with a larger valve stem height difference, the closure force of the respective valve spring becomes effective and not only the difference of the valve spring forces since the one valve is already closed. The larger torque at the lever 22 effects also a larger pressure increase at the supporting piston 24 or 25 in the cylinder space thereof so that per time unit more oil volume is displaced out of the cylinder space.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A valve control for a reciprocating piston internal combustion engine in which at least two valves per cylinder head are actuated in unison by a traverse means displaced by a rocker arm means, and in which the traverse means is pivotally constructed, comprising a bolt means operable to guide the traverse means rectilinearly is rotatably arranged at the cylinder head transversely to the connecting line of the valves, the traverse means having a rectilinear guide means for rotating the bolt means, a self-adjusting torque support means cooperating with the bolt means comprising a lever means non-rotatably connected with the bolt means and two oil pressure actuated pistons mutually engaging opposite sides of the lever means.

2. A valve control according to claim 1, wherein the cylinder spaces of the pistons are in communication with at least one throttling place by way of a channel.

3. A valve control according to claim 2, wherein a means for eliminating clearance in the valve control is operatively interconnected between a cam shaft initiating the valve actuation and the traverse means.

4. A valve control in accordance with claim 1, further comprising means in the cylinder head for applying the oil pressure to the oil pressure actuated pistons.

5. A valve control according to claim 2, further comprising means in the cylinder head for applying a force to actuate the self-adjusting torque support means.

6. A valve control for a reciprocating piston internal combustion engine in which at least two valves per cylinder head are actuated in unison by a traverse means displaced by a rocker arm means, and in which the traverse means is pivotally constructed, characterized in that a bolt means operable to guide the traverse means rectilinearly is rotatably arranged at the cylinder head transversely to the connecting line of the valves, in that the bolt means is rotatable by the traverse means by way of a rectilinear guide means, in that the bolt means cooperates with a self-adjusting torque support means, in that a means for eliminating clearance in the valve control is operatively interconnected between a cam shaft initiating the valve actuation and the traverse means and in that a lever means non-rotatably connected with the bolt means and two oil pressure actuated pistons engaging mutually oppositely at the lever means form the torque support means.

* * * * *